US005743225A

United States Patent [19]

Sakurai

[11] Patent Number: 5,743,225

[45] Date of Patent: Apr. 28, 1998

[54] VALVE SYSTEM FOR ENGINE

[75] Inventor: Kazuhiro Sakurai, Gotenba, Japan

[73] Assignee: Toyota Jidosha Kabushiki Kaisha, Aichi, Japan

[21] Appl. No.: 835,596

[22] Filed: Apr. 10, 1997

[30] Foreign Application Priority Data

Apr. 19, 1996 [JP] Japan ..... 8-098210

[51] Int. Cl.[6] ..... F01L 1/26; F01L 3/10

[52] U.S. Cl. ..... 123/90.65; 123/90.15; 123/90.67; 123/315; 123/90.22

[58] Field of Search ..... 123/90.15, 90.16, 123/90.17, 90.22, 90.27, 90.6, 90.65, 90.66, 90.67, 315, 342

[56] References Cited

U.S. PATENT DOCUMENTS

| | | | |
|---|---|---|---|
| 4,446,825 | 5/1984 | Giardini et al. | 123/90.65 |
| 5,269,270 | 12/1993 | Suzuki | 123/315 |
| 5,558,054 | 9/1996 | Ariga et al. | 123/90.65 |
| 5,664,531 | 9/1997 | Kim | 123/90.65 |
| 5,669,341 | 9/1997 | Ushirono et al. | 123/315 |

FOREIGN PATENT DOCUMENTS

| | | |
|---|---|---|
| 0 322 572 | 7/1989 | European Pat. Off. . |
| 0 453 416 | 10/1991 | European Pat. Off. . |
| 1159417A | 6/1989 | Japan . |

OTHER PUBLICATIONS

Patent Abstracts of Japan, vol. 009, No. 268 (M-424), 25 Oct. 1985 & JP 60 113007 (Nissan Jidosha KK), 19 Jun. 1985.

*Primary Examiner*—Weilun Lo
*Attorney, Agent, or Firm*—Kenyon & Kenyon

[57] ABSTRACT

A valve system for an engine comprises a plurality of intake or exhaust valves, adapted to be driven by cams of which the profiles are different from each other to make maximum valve lifts of the valves different from each other, and compression springs biassing the valves toward the corresponding closing directions, the springs being identical to each other. An initial length of the spring is made shorter as the maximum valve lift of the valve becomes smaller, to make an initial load of the spring larger as the maximum valve lift of the valve becomes smaller.

7 Claims, 5 Drawing Sheets

VALVE SYSTEM FOR ENGINE

BACKGROUND OF THE INVENTION

1. Field of the Invention

The present invention relates to a valve system for an engine.

2. Description of the Related Art

Japanese Unexamined Patent Publication No. 1-159417 discloses a valve system for an engine having a pair of exhaust valves, in which valve opening periods of the exhaust valves are different from each other to suppress the pulsation of the exhaust gas flow, to thereby reduce the pumping loss of the engine. Note that, in such a valve system, each exhaust valve is biassed by a compression spring toward the closing direction thereof, and opens when the opening force due to the associated cam becomes larger than the spring force of the compression spring.

In the valve system, to make the valve opening periods of the exhaust valves different from each other, the profiles of the cams are made different from each other. In this case, the maximum valve lift of the exhaust valve becomes larger as the valve opening period thereof becomes longer, if the profiles of the cams are defined considering the durability and reliability of the exhaust valves as in the usual manner. Thus, the maximum valve lifts are different from each other, if the valve opening periods are made different from each other, as in the above-mentioned valve system.

In the valve system in which the maximum valve lifts are made different from each other in this manner, the dynamic characteristic of each exhaust valve can be made optimum if the elements used with the exhaust valve such as the compression spring, are optimized for the respective exhaust valve. However, if the different elements are used for the different exhaust valves, the number of the elements and the costs therefor increase. Further, the elements are preferably identical for every exhaust valve, considering the assembly of the valve system.

However, if the compression spring optimum for the exhaust valve having the shorter valve opening period is used with the exhaust valve having the longer valve opening period, a minimum excess load, which is a minimum value of the difference between the spring force of the compression spring and the inertia of the exhaust valve, becomes excessively larger. This results in increasing the friction on the exhaust valve having the longer valve opening period, and thus the fuel consumption rate may become low and the surface of the cam may wear out. On the other hand, if the compression spring optimum for the exhaust valve having the longer valve opening period is used with the exhaust valve having the shorter valve opening period, the minimum excess load becomes excessively smaller. As a results, the response of the exhaust valve having the shorter valve opening period with respect to the corresponding cam may deteriorate and thus the exhaust valve may jump or bounce. Further, in this case, the maximum engine speed must be limited because the surging of the spring for the shorter valve opening period may occur if the engine speed becomes higher. JPP'417 mentioned above does not teach a solution to any of the above problems.

SUMMARY OF THE INVENTION

An object of the present invention is to provide a valve system for an engine capable of ensuring a good operation of the valves, while simplifying the structure and the assembly of the valve system.

According to the present invention; there is provided a valve system for an engine comprising: a plurality of intake or exhaust valves adapted to be driven by cams, of which profiles are different from each other to make maximum valve lifts of the valves different from each other; and compression springs biassing the valves toward the corresponding closing directions, the springs being identical to each other; wherein an initial length of the spring is made shorter as the maximum valve lift of the valve becomes smaller, to make an initial load of the spring larger as the maximum valve lift of the valve becomes smaller.

The present invention may be more fully understood from the description of the preferred embodiments of the invention as set forth below, together with the accompanying drawings.

DESCRIPTION OF THE PREFERRED EMBODIMENTS

Figure 1:
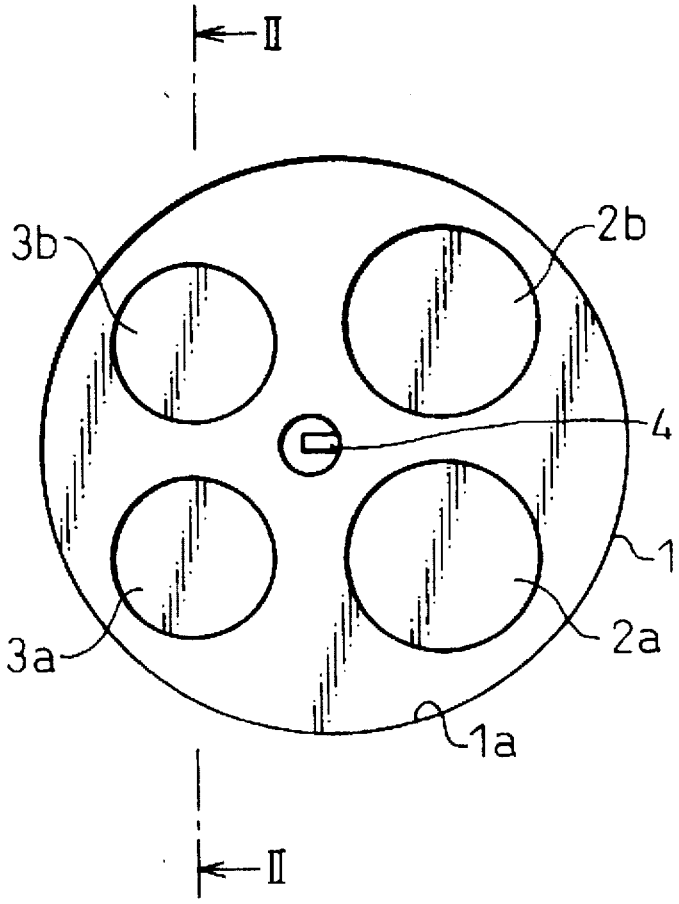
FIG. 1 is an plan view of an inner wall of a cylinder head of an engine.
Figure 2:
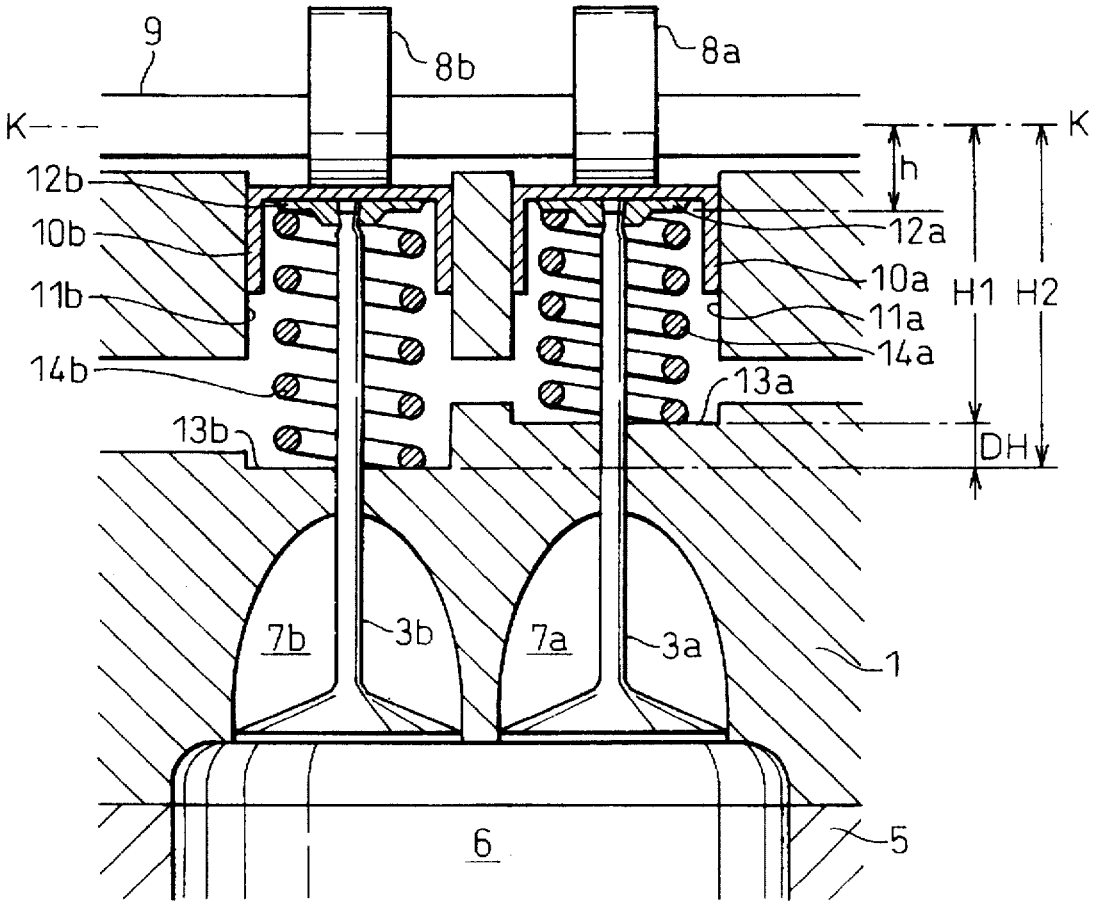
FIG. 2 is a partial cross sectional view of the cylinder head along the line II—II shown in FIG. 1.

FIGS. 1 and 2 illustrate a case where the present invention is applied to a pair of exhaust valves of an engine. Alternatively, the present invention may be applied to more than two exhaust valves, a plurality of intake valves of an engine, or both the exhaust and intake valves.

Referring to FIG. 1, first and second intake valves 2*a* and 2*b* are arranged on one side of an inner wall 1*a* of a cylinder head 1 of an engine, and first and second exhaust valves 3*a* and 3*b* are arranged on the other side of the inner wall 1*a* of the cylinder head 1. The intake valves 2*a* and 2*b* are formed by the identical members, and the exhaust valves 3*a* and 3*b* also formed by the identical members. Further, a spark plug 4 is arranged generally at the center of the inner wall 1*a*.

Referring to FIG. 2, the reference numerals 5 and 6 respectively designate a cylinder block and a combustion chamber of the engine, 7*a* and 7*b* respectively designate first and second exhaust ports formed in the cylinder head 1, and 8*a* and 8*b* respectively designate first and second cams for respectively driving the first and second exhaust valves 3*a* and 3*b*. The cams 8*a* and 8*b* are formed on a common cam shaft 9, which rotates about an axis K—K.

Valve lifters 10*a* and 10*b* are arranged between the tops of the exhaust valves 3*a* and 3*b* and the associated cams 8*a* and 8*b*, and slidably reciprocate within guide holes 11*a* and 11*b* formed in the cylinder head 1, while being guided by the corresponding guide holes 11*a* and 11*b*. Further, valve spring retainers 12*a* and 12*b* are connected to the tops of the exhaust valves 3*a* and 3*b*, via locks (not shown).

Valve spring seats 13*a* and 13*b* are formed in the cylinder head 1 around the stem portions of the exhaust valves 3*a* and 3*b*, each having a recessed configuration. Valve springs 14*a* and 14*b* are inserted between the valve spring retainers 12*a* and 12*b* and the corresponding valve spring seats 13*a* and 13*b*, in a compressed state. The valve springs 14*a* and 14*b* urge the associated exhaust valves 3*a* and 3*b* toward the respective closed position of the valves 3*a* and 3*b*.

As shown in FIG. 2, the valve spring seat 13*a* for the first exhaust valve 3*a* is formed to make the distance H from the cam axis K—K equal to H1, and the valve spring seat 13*b* for the second exhaust valve 3*b* is formed to make the distance H from the cam axis K—K equal to H2, which is longer than H1 by DH. When the exhaust valves 3*a* and 3*b* are closed, the distances between the cam axis K—K and the bottom surfaces of the valve spring retainers 12*a* and 12*b* are identical to each other, and are represented by "h" in FIG. 2. Therefore, if the lengths of the valve springs 14*a*, 14*b* when the exhaust valves 3*a* and 3*b* are kept closed is referred to as an initial length, the initial length of the valve spring 14*a* is represented by H1-h, and that of the valve spring 14*b* is represented by H2-h, which is longer than that of the valve spring 14*a* by DH.

The valve lifters 10*a* and 10*b*, the valve spring retainer 12*a* and 12*b*, and the valve springs 14*a* and 14*b* are respectively formed by the identical members. In other words, the elements for the first exhaust valve 3*a* and those for the second exhaust valve 3*b* are identical. This avoids assembly errors.

The opening forces of the cams 8*a* and 8*b* act on the associated exhaust valves 3*a* and 3*b* via the corresponding valve lifter 10*a* and 10*b*, respectively, and the exhaust valve 3*a*, 3*b* will open when the opening force acting thereon becomes larger than the closing force of the corresponding valve spring 14*a*, 14*b*.

Figure 3:
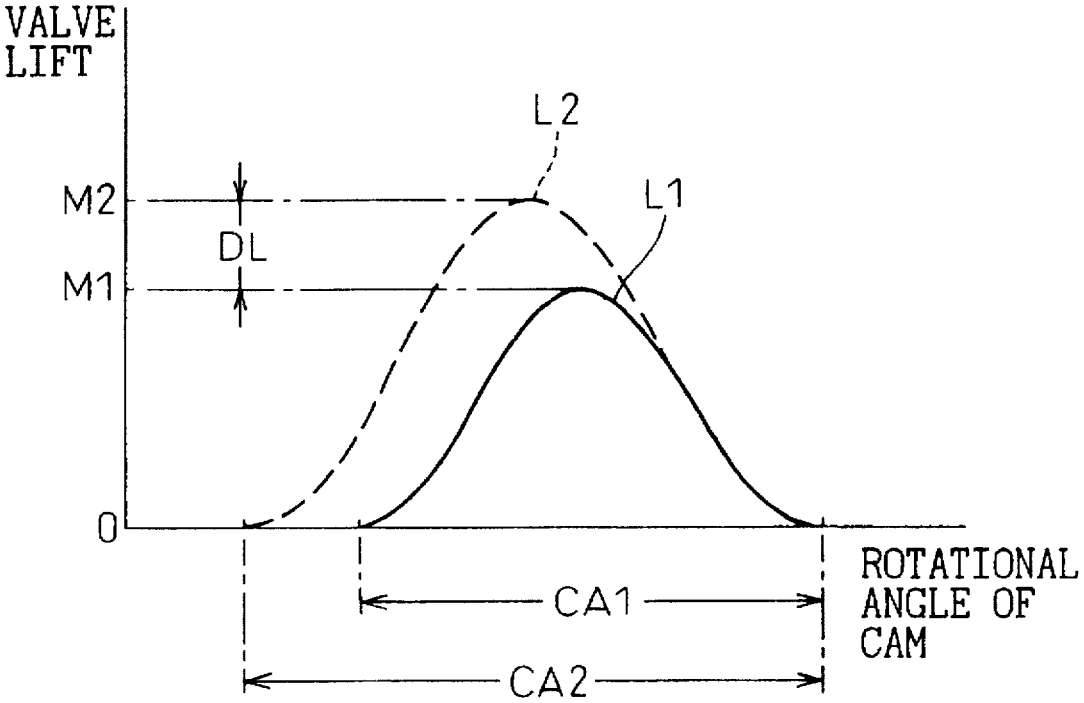
FIG. 3 is a diagram illustrating valve lift curves.

FIG. 3 illustrates valve lift curves of the exhaust valves 3*a* and 3*b*, the valve lift curves illustrating the relationships between the valve lift of a valve and the rotational angle of a cam. In FIG. 3, the curve L1 shows the valve lift curve of the first exhaust valve 3*a* and the curve L2 shows the valve lift curve of the second exhaust valve 3*b*. As shown in FIG. 3, the first exhaust valve 3*a* opens for a period corresponding to the cam rotational angle CA1, and the second exhaust valve 3*b* opens for a period corresponding to the cam rotational angle CA2. Namely, the valve opening period of the second exhaust valve 3*b* is longer than that of the first exhaust valve 3*a*. Making the valve opening periods of the first and second exhaust valves 3*a* and 3*b* different from each other in this manner, reduces the pulsation of the exhaust gas flow and thereby the pumping loss of the engine, as mentioned at the beginning of the specification. Note that, as shown in FIG. 3, the closing timings of the first and second exhaust valves 3*a* and 3*b* substantially conform to each other. This ensures the stability of the engine during the engine idling operation.

Figure 4:
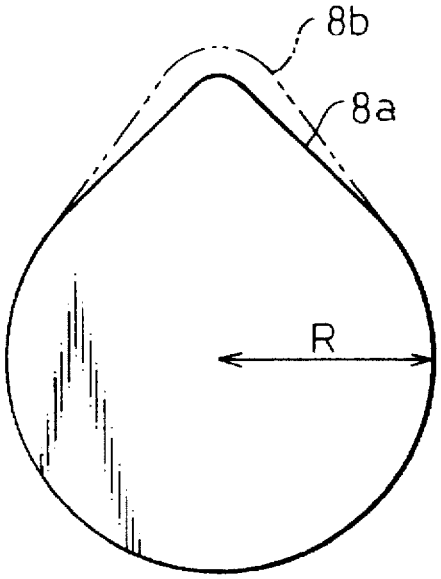
FIG. 4 is a side view of the cams.

To make the valve opening periods of the exhaust valves 3*a* and 3*b* different from each other, the profiles of the cams 8*a* and 8*b* are made different from each other, as shown in FIG. 4. This simplifies the structure of the valve system. Note that the radius R of the basic circles of the cams 8*a* and 8*b* are identical to each other.

Generally, a profile of a cam is defined to make the maximum valve lift of the associated valve as large as possible, while preventing the response of the valve from deteriorating and preventing the striking sound of the cam from being loud. Thus, if the profiles of the cams are defined to make the valve opening periods different from each other under these limitations, the maximum valve lifts are made different from each other. Namely, as shown in FIG. 3, the maximum valve lift M1 of the first exhaust valve 3*a* is smaller than the maximum valve lift M2 of the second exhaust valve 3*b*, by DL. Further, when the profiles of the cams 8*a* and 8*b* are defined under the above-mentioned limitations, the relationships between the accelerations of the exhaust valves 3*a* and 3*b* and ratios of the valve lifts of the exhaust valves 3*a* and 3*b* to the corresponding maximum valve lifts are made substantially identical to each other.

Figure 5:
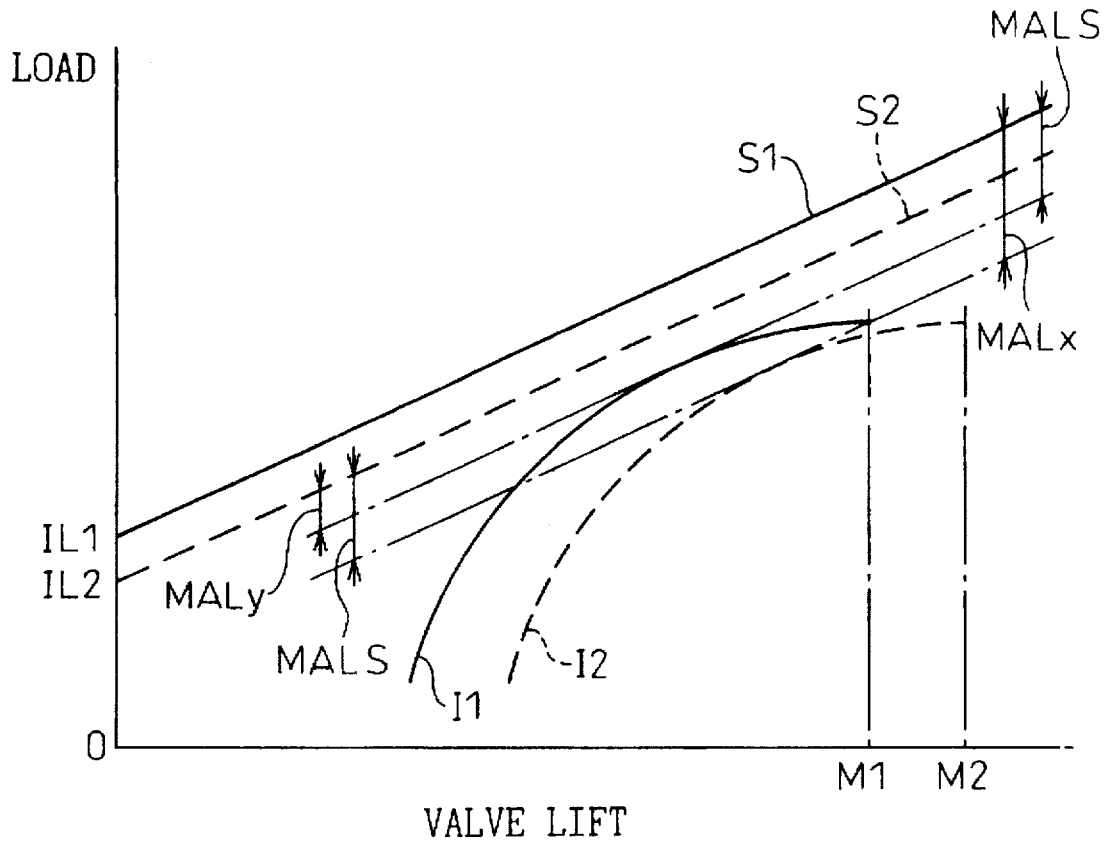
FIG. 5 is a diagram illustrating the relationships between loads acting on a valve spring and valve lifts.

Next, the method for setting the distance H between the cam axis K—K and the valve spring seat 13*a*, 13*b* will be explained, with reference to FIG. 5, as well as FIG. 2. In FIG. 5, curves I1 and I2 partly illustrate the inertia of the first and second exhaust valve 3*a* and 3*b*, respectively.

Conventionally, the valve spring seats are formed to make the distances H identical to each other, and thus the initial lengths of the valve springs 14*a* and 14*b* are identical to each other. In this case, if the identical valve springs are used, initial loads acting on the valve springs 14*a* and 14*b* are identical to each other, and thereby spring force curves of the valve springs 14*a* and 14*b* are made identical to each other. Note that an initial load is a load acting on the valve spring 14*a*, 14*b* when the corresponding exhaust valve 3*a*, 3*b* is kept closed, and a spring force curve illustrates the relationships between the spring force of the valve spring 14*a*, 14*b* and the cam rotational angle.

Namely, if the valve spring seats 13*a* and 13*b* are formed to make both the initial lengths of the valve springs 14*a* and 14*b* equal to H1-h, both the initial loads of the valve springs 14*a* and 14*b* are made equal to IL1, and thus both the spring force curves of the valve springs 14*a* and 14*b* in this case conform to the curve S1 shown in FIG. 5. Contrarily, if the valve spring seats 13*a* and 13*b* are formed to make both the initial lengths of the valve springs 14*a* and 14*b* equal to H2-h, both the initial loads are made equal to IL2, and thus both the spring force curves conform to the curve S2 shown in FIG. 5.

However, when the maximum valve lifts of the exhaust valves 3*a* and 3*b* are different from each other as in the present embodiment, the inertia curves I1 and I2 of the exhaust valves 3*a* and 3*b* are different from each other, as shown in FIG. 5. In this condition, if both the spring force curves of the valve springs 14 and 14*b* are made identical to the curve S1 in FIG. 5, the minimum excess load of the second exhaust valve 3*b* is equal to the excessively larger value MALx, while the minimum excess load of the first exhaust valve 3*a* is equal to the optimum value MALS. If the minimum excess load becomes excessively large as in this case, the friction between the cams 8*a* and 8*b* and valve lifts 10*a* and 10*b* increases, and thus the fuel consumption rate becomes low and the surfaces of the cams or the valve lifters wear out.

Contrarily, if both the spring force curves of the valve springs 14 and 14*b* are made identical to the curve S2 in FIG. 5, the minimum excess load of the first exhaust valve 3*a* is made equal to the excessively smaller value MALy, while the minimum excess load of the second exhaust valve 3*b* is made equal to the optimum value MALS. If the minimum excess load becomes excessively smaller as in this case, the responses of the exhaust valves 3*a* and 3*b* with respect to the cams 8*a* and 8*b* deteriorate, and thus jumping and bouncing of the exhaust valves occurs. Further, in this case, the maximum engine speed should be limited because the surging of the spring may occur if the engine speed becomes higher.

Accordingly, when the maximum valve lifts of the exhaust valves 3*a* and 3*b* are different from each other and thereby the inertia curves of the exhaust valves 3*a* and 3*b* are different from each other, it is necessary to make the spring force curves of the valve springs 14*a* and 14*b* different from each other, to thereby optimize the minimum excess load of the respective exhaust valve 3*a*, 3*b*. Namely, when the valve springs are identical to each other and thereby the spring constants thereof are identical, it is necessary to make the initial length shorter as the maximum valve lift becomes smaller, to make the initial load larger as the maximum valve lift becomes smaller.

Therefore, in the present embodiment, the valve spring seat 13*b* for the exhaust valve 3*b* having the larger maximum valve lift is formed to make the distance H equal to H2 to make the initial lengths of the valve spring 14*b* equal to H2-h, and the valve spring seat 13*a* for the exhaust valve 3*a* having the smaller maximum valve lift is formed to make the distance H equal to H1, which is shorter than H2 by DH, to make the initial lengths of the valve spring 14*a* equal to H1-h, which is shorter than H2 by DH. As a result, the initial load of the valve spring 14*b* is made equal to IL2, and the spring force curve of the valve spring 14*b* conforms to the curve S2, and the initial load of the valve spring 14*a* is made equal to IL1, which is IL2, than IL2, and the spring force curve of the valve spring 14*a* conforms to S1. Accordingly, both the minimum excess loads of the exhaust valves 3*a* and 3*b* are made equal to the optimum value MALS.

According to the present embodiment, the initial lengths and initial loads of the valve springs 14*a* and 14*b* are adjusted by adjusting the distance H of the valve spring seats 13*a* and 13*b*, and the distance H is simply adjusted by the design of the mold for molding the cylinder head 1. Namely, the special machining and the additional elements are unnecessary, and thus the valve system is constructed at low cost and easily.

Figure 6:
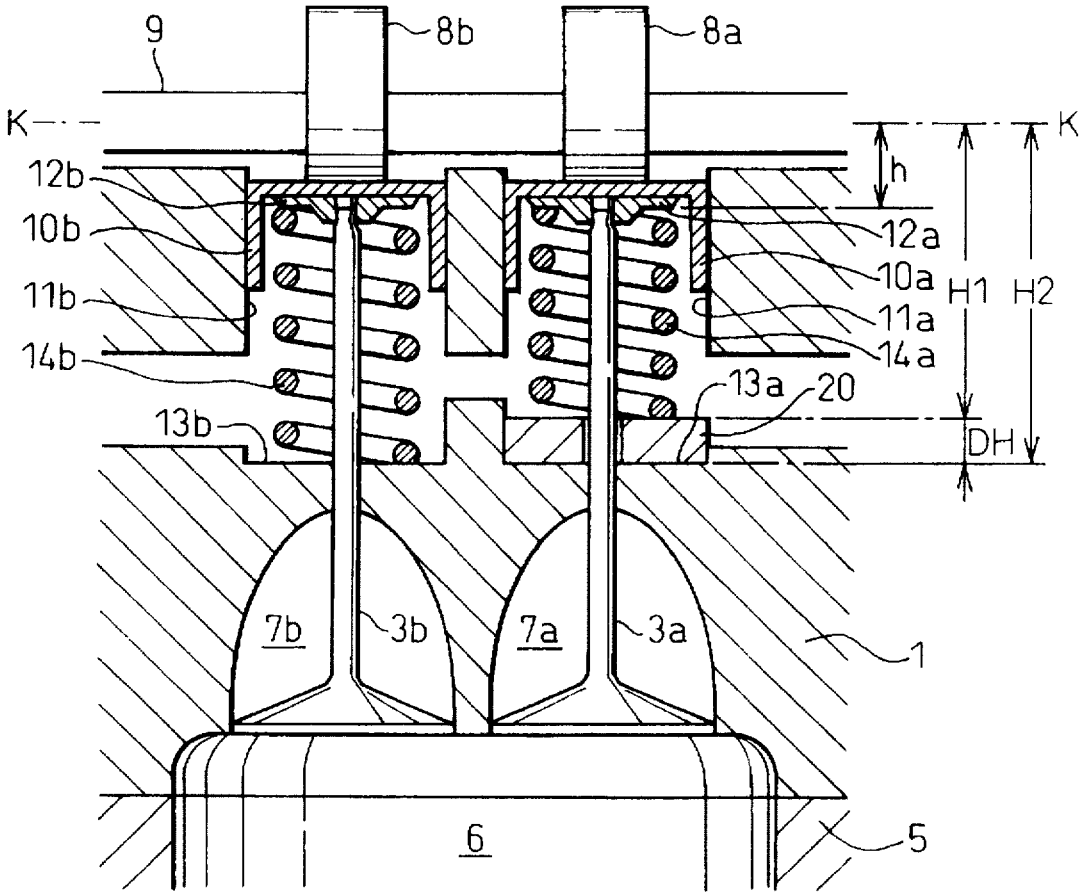
FIG. 6 is a partial cross sectional view of the cylinder head, similar to FIG. 2, according to another embodiment of the present invention.

FIG. 6 illustrates another embodiment of the present invention.

Referring to FIG. 6, the distance H of the valve spring seats 13*a* and 13*b* are made equal to H2. However, a spacer 20 having a thickness of DH is inserted between the bottom end of the valve spring 14*b* and the associated valve spring seat 13*b*. As a result, the initial lengths of the valve spring 14*b* is made equal to H2-h, and that of the valve spring 14*a* is made equal to H1-h, which is shorter than H2 by DH, as in the previous embodiment. Such a spacer makes the initial lengths and initial loads of the valve springs 14*a* and 14*b* adjustable in the conventional cylinder head.

Alternatively, the initial length of the valve spring may be adjusted by adjusting the radius of the basic circle of the associated cam.

According to the present invention, it is possible to provide a valve system for an engine capable of ensuring a good operation of the valves, while simplifying the structure and the assembly of the valve system.

While the invention has been described by reference to specific embodiments chosen for purposes of illustration, it should be apparent that numerous modifications could be made thereto by those skilled in the art without departing from the basic concept and scope of the invention.

I claim:

1. A valve system for an engine comprising:

a plurality of intake or exhaust valves adapted to be driven by cams, of which the profiles are different from each other to make maximum valve lifts of the valves different from each other; and compression springs biassing the valves toward the corresponding closing directions, the springs being identical to each other;

wherein an initial length of the spring is made shorter as the maximum valve lift of the valve becomes smaller, to make an initial load of the spring larger as the maximum valve lift of the valve becomes smaller.

2. A system according to claim 1, wherein the springs are connected to tops of the valves at one end thereof, and are supported on spring seats formed in a cylinder head of the engine, and wherein the spring seats are formed to make the distance of the spring seat, from the top of the corresponding valve when the valve is kept closed, shorter as the maximum valve lift of the valve becomes smaller, to thereby make the initial length of the spring shorter as the maximum valve lift of the valve becomes smaller.

3. A system according to claim 2, wherein the cams are arranged above the tops of the valves, and are carried on a common cam shaft having a cam axis, and where the spring seats are formed to make a distance of the spring seat from the cam axis shorter as the maximum valve lift of the valve becomes smaller, to thereby make the initial length of the spring shorter as the maximum valve lift of the valve becomes smaller.

4. A system according to claim 1, wherein the springs are connected to tops of the valves at one end thereof, and are supported on spring seats formed in a cylinder head of the engine, and wherein a spacer is inserted between the bottom end of at least one spring and the corresponding spring seat, the thickness of the spacer being defined to make the initial length of the spring shorter as the maximum valve lift of the valve becomes smaller.

5. A system according to claim 1, wherein the valves comprises a pair of exhaust valves.

6. A system according to claim 1, wherein a valve opening period of the valve becomes longer as the maximum valve lift of the valve becomes larger.

7. A system according to claim 6, wherein the opening timing of the valve becomes earlier as the valve opening period of the valve becomes longer.

* * * * *

UNITED STATES PATENT AND TRADEMARK OFFICE

CERTIFICATE OF CORRECTION

PATENT NO. : 5,743,225

DATED : April 28, 1998

INVENTOR(S) : Kazuhiro SAKURAI

It is certified that error appears in the above-indentified patent and that said Letters Patent is hereby corrected as shown below:

Column 1, line 53, change "results" to --result--.

Column 2, line 20, change "an plan" to --a plan--.

Column 2, line 46, after "3b" insert --are--.

Column 3, line 15, change "is" to --are--.

Column 3, line 20, change "retainer" to --retainers--.

Column 3, line 29, change "lifter" to --lifters-- and "valve" to --valves--.

Column 4, line 42, after "springs 14" insert --a--.

Column 4, line 53, after "springs 14" insert --a--.

Column 5, line 22, change "which is II.2" to --which is larger--.

Column 5, line 38, change "are" to --is--.

UNITED STATES PATENT AND TRADEMARK OFFICE

CERTIFICATE OF CORRECTION

PATENT NO. : 5,743,225

DATED : April 28, 1998

INVENTOR(S) : Kazuhiro SAKURAI

It is certified that error appears in the above-indentified patent and that said Letters Patent is hereby corrected as shown below:

Column 5, line 40, change "lengths" to --length--.

Column 6, line 45, change "comprises" to --comprise--.

Signed and Sealed this

Fourteenth Day of March, 2000

*Attest:*

*Attesting Officer*

Q. TODD DICKINSON

*Commissioner of Patents and Trademarks*